US010006143B2

(12) United States Patent
Mochizuki et al.

(10) Patent No.: US 10,006,143 B2
(45) Date of Patent: Jun. 26, 2018

(54) POWER SUPPLYING MEMBER AND HIGH-SPEED PLATING MACHINE PROVIDED WITH THE SAME

(71) Applicant: KYB CORPORATION, Minato-ku, Tokyo (JP)

(72) Inventors: Yoshitaka Mochizuki, Tokyo (JP); Toshihisa Miyazaki, Nagoya (JP); Akira Takamatsu, Nagoya (JP)

(73) Assignee: KYB CORPORATION, Minato-Ku, Tokyo (JP)

( * ) Notice: Subject to any disclaimer, the term of this patent is extended or adjusted under 35 U.S.C. 154(b) by 230 days.

(21) Appl. No.: 14/897,186

(22) PCT Filed: Jun. 6, 2014

(86) PCT No.: PCT/JP2014/065050
§ 371 (c)(1),
(2) Date: Dec. 9, 2015

(87) PCT Pub. No.: WO2014/199908
PCT Pub. Date: Dec. 18, 2014

(65) Prior Publication Data

US 2016/0108540 A1 Apr. 21, 2016

(30) Foreign Application Priority Data

Jun. 14, 2013 (JP) ..... 2013-125556

(51) Int. Cl.
*C25D 17/12* (2006.01)
*C25D 5/08* (2006.01)
(Continued)

(52) U.S. Cl.
CPC ..... *C25D 17/007* (2013.01); *C25D 5/08* (2013.01); *C25D 7/00* (2013.01); *C25D 17/005* (2013.01);
(Continued)

(58) Field of Classification Search
USPC ..... 205/151
See application file for complete search history.

(56) References Cited

U.S. PATENT DOCUMENTS 3,649,477 A 3/1972 Bart
3,960,675 A * 6/1976 Moller ..... C25D 3/02 205/127
(Continued)

FOREIGN PATENT DOCUMENTS

CN 1329969 A 1/2002
CN 101137772 A 3/2008
(Continued)

OTHER PUBLICATIONS

Machine translation of JP 09-031686 A, obtained from http://worldwide.espacenet.com, accessed on Sep. 21, 2017 (Year: 2017).*
(Continued)

*Primary Examiner* — Harry D Wilkins, III
(74) *Attorney, Agent, or Firm* — Smith, Gambrell & Russell, LLP

(57) ABSTRACT

Providing a power-supplying member capable of desirably performing plating for a long period of time. A second power-supplying member is brought into contact with an article to be plated to apply negative voltage to the article. The article is disposed in a state such that a space in which a plating solution flows is defined between an anode and the article. The second power-supplying member includes a center member made from copper and a covering member made from titanium and covering at least a part of a periphery of the center member. The part is wetted with the plating solution.

6 Claims, 18 Drawing Sheets

(51) Int. Cl.

| | |
|---|---|
| ***C25D 17/00*** | (2006.01) |
| ***C25D 17/10*** | (2006.01) |
| ***C25D 21/10*** | (2006.01) |
| ***C25D 7/00*** | (2006.01) |
| ***C25D 17/06*** | (2006.01) |

(52) U.S. Cl.
CPC ..... *C25D 17/06* (2013.01); *C25D 17/10* (2013.01); *C25D 17/12* (2013.01); *C25D 21/10* (2013.01)

(56) References Cited

U.S. PATENT DOCUMENTS

| | | | | | |
|---|---|---|---|---|---|
| 4,409,086 | A * | 10/1983 | Haas | C25B 9/02 204/269 |
| 4,543,172 | A | 9/1985 | Suzuki et al. | |
| 4,592,819 | A | 6/1986 | Suzuki et al. | |
| 4,693,792 | A * | 9/1987 | Datwyler | C25D 7/04 204/218 |
| 4,948,486 | A | 8/1990 | Hosten | |
| 5,082,543 | A | 1/1992 | Gnann et al. | |
| 5,458,755 | A | 10/1995 | Fujiyama et al. | |
| 5,527,445 | A | 6/1996 | Palumbo et al. | |
| 6,051,118 | A | 4/2000 | Asaki et al. | |
| 6,200,452 | B1 * | 3/2001 | Angelini | C25D 7/04 204/198 |
| 6,547,936 | B1 * | 4/2003 | Metzger | C25D 5/20 204/212 |
| 6,547,945 | B2 * | 4/2003 | Shallow | C25D 5/08 204/224 M |
| 7,285,191 | B2 * | 10/2007 | Asakawa | C25D 17/00 204/199 |
| 8,821,699 | B2 * | 9/2014 | Nisco | C25D 17/005 204/198 |
| 2001/0040090 | A1 | 11/2001 | Kuroda et al. | |
| 2002/0003092 | A1 | 1/2002 | Engert et al. | |
| 2010/0276280 | A1 | 11/2010 | Matsui et al. | |
| 2011/0233053 | A1 | 9/2011 | Kobayashi et al. | |
| 2016/0108542 | A1 | 4/2016 | Mochizuki et al. | |
| 2016/0130714 | A1 | 5/2016 | Mochizuki et al. | |

FOREIGN PATENT DOCUMENTS

| | | | | | |
|---|---|---|---|---|---|
| CN | 101421441 | | | 4/2009 | |
| CN | 201473614 | U | | 5/2010 | |
| CN | 201495306 | U | | 6/2010 | |
| EP | 0059481 | A1 | | 9/1982 | |
| EP | 0848765 | B1 | | 2/2006 | |
| JP | 55-138097 | A | | 10/1980 | |
| JP | 57158396 | A | * | 9/1982 | C25D 5/22 |
| JP | 62-164899 | A | | 7/1987 | |
| JP | H08-209396 | A | | 8/1996 | |
| JP | 9-31686 | A | | 2/1997 | |
| JP | 2000-073197 | A | | 3/2000 | |
| JP | 2000-239893 | A | | 9/2000 | |
| JP | 2001-172793 | A | | 6/2001 | |
| JP | 2002-256497 | A | | 9/2002 | |
| JP | 2005-281849 | A | | 10/2005 | |
| JP | 2006-016651 | A | | 1/2006 | |
| JP | 2006-131969 | A | | 5/2006 | |
| JP | 2007-284736 | A | | 11/2007 | |
| JP | 2011-219858 | A | | 11/2011 | |
| JP | 2013-060658 | A | | 4/2013 | |

OTHER PUBLICATIONS

International Search Report for PCT/JP2014/065050, dated Aug. 26, 2014 in English & Japanese Language.

Written Opinion of the International Searching Authority for PCT/JP2014/065050 dated Dec. 14, 2015 (7 pages).

International Preliminary Report on Patentability for PCT/JP2014/065050 dated Dec. 15, 2015 (12 pages).

Extended European Search Report dated Feb. 20, 2017 for European Patent Application No. 14810276.7 (7 pages).

Japanese Office Action dated Apr. 25, 2017 Japanese Patent Application No. 2013-125556 (6 pages Japanese with English Translation).

Office Action and Search Report dated Dec. 13, 2016 for Chinese Patent Application No. 201480033950.2 (5 pages).

European Search Opinion dated Feb. 22, 2017 for European Patent Application No. 14810276.7 (3 pages).

* cited by examiner

POWER SUPPLYING MEMBER AND HIGH-SPEED PLATING MACHINE PROVIDED WITH THE SAME

TECHNICAL FIELD

The present invention relates to a power-supplying member and a high-speed plating machine provided with the same.

BACKGROUND ART

Undermentioned Patent Document 1 discloses a conventional high-speed plating machine. The high-speed plating machine includes a closed container constructed of a metal cylinder serving as an anode and lid members integrally connected to both ends of the metal cylinder respectively. The metal cylinder is made from copper and has an inner surface and end surfaces on all of which thin films of platinum are deposited respectively. The two opposed lid members are provided with respective insertion holes through which plug members are slidingly inserted. The plug members hold an article to be plated, therebetween and constitute a part of a holding device. The plug members also serve as power supplying members which are brought into contact with the article to apply negative voltage to the article. Each plug member is covered with a corrosion-resistant resin to prevent each plug member from being melted by a plating solution.

The high-speed plating machine also includes a power-supply unit which energizes the metal cylinder and the plug members so that positive voltage is applied to the metal cylinder and the negative voltage is applied to the article to be plated. The high-speed plating machine further includes a circulation unit which comprises a pump circulating a plating solution so that the plating solution flows in the closed container.

In the high-speed plating machine, the article to be plated held between the plug members is put into the closed container and the pump is then driven so that the plating solution flows in the closed container. The positive voltage is applied to the metal cylinder and the negative voltage is applied via the plug members to the article, with the result that a high-speed plating can be carried out with a plating time being reduced.

PRIOR ART DOCUMENT

Patent Documents

Patent Document 1: Japanese Patent Application Publication No. JP-A-S55-138097

SUMMARY OF THE INVENTION

Problem to be Overcome by the Invention

However, the plug members of the high-speed plating machine disclosed in Patent document 1 are slid in the respective insertion holes, and generate heat and expand when the negative voltage is applied to the plug members. Accordingly, there is a possibility that the corrosion-resistant resin covering the plug members for prevention of melting by the plating solution may be deteriorated thereby to be peeled off. When the corrosion-resistant resin covering the plug members is peeled off, there is a possibility that the plug members would be melted by the plating solution or that the plating solution would leak through gaps between outer peripheries of the plug members and inner peripheries of the insertion holes respectively. This requires replacement of the plug members.

The present invention was made in view of the foregoing circumstances and a subject matter to be overcome is to provide a power-supplying member which can realize a desirable plating for a longer period of time and also to provide a high-speed plating machine provided with the power-supplying member.

Means for Overcoming the Problem

A power-supplying member of the present invention is brought into contact with an article to be plated to apply negative voltage to the article. The article is disposed in a state such that a space in which a plating solution flows is defined between an anode and the article. The power-supplying member includes a center member made from copper and a covering member made from titanium and covering at least a part of a periphery of the center member, the part being wetted with the plating solution.

Effect of the Invention

The power-supplying member includes a part wetted by the plating solution, in which part center member made from copper is covered by the covering member made from titanium having a higher corrosion resistance than copper. Accordingly, the power-supplying member has an improved corrosion resistance to the plating solution. As a result, the replacement frequency of the power-supplying member can be reduced. Further, since the power-supplying member is provided with the center member made from copper having a higher electrical conductivity than titanium, the power-supplying member can suppress heat generation during power supply as compared with a power-supplying member made from only titanium, with the result that a temperature rise of the plating solution can be reduced.

Accordingly, the power-supplying member and the high-speed plating machine provided with the power-supplying member can perform plating in good condition for a long period of time.

MODE FOR CARRYING OUT THE INVENTION

An embodiment of the high-speed plating machine provided with the power-supplying member of the present invention will be described with reference to the drawings.

Figure 1:
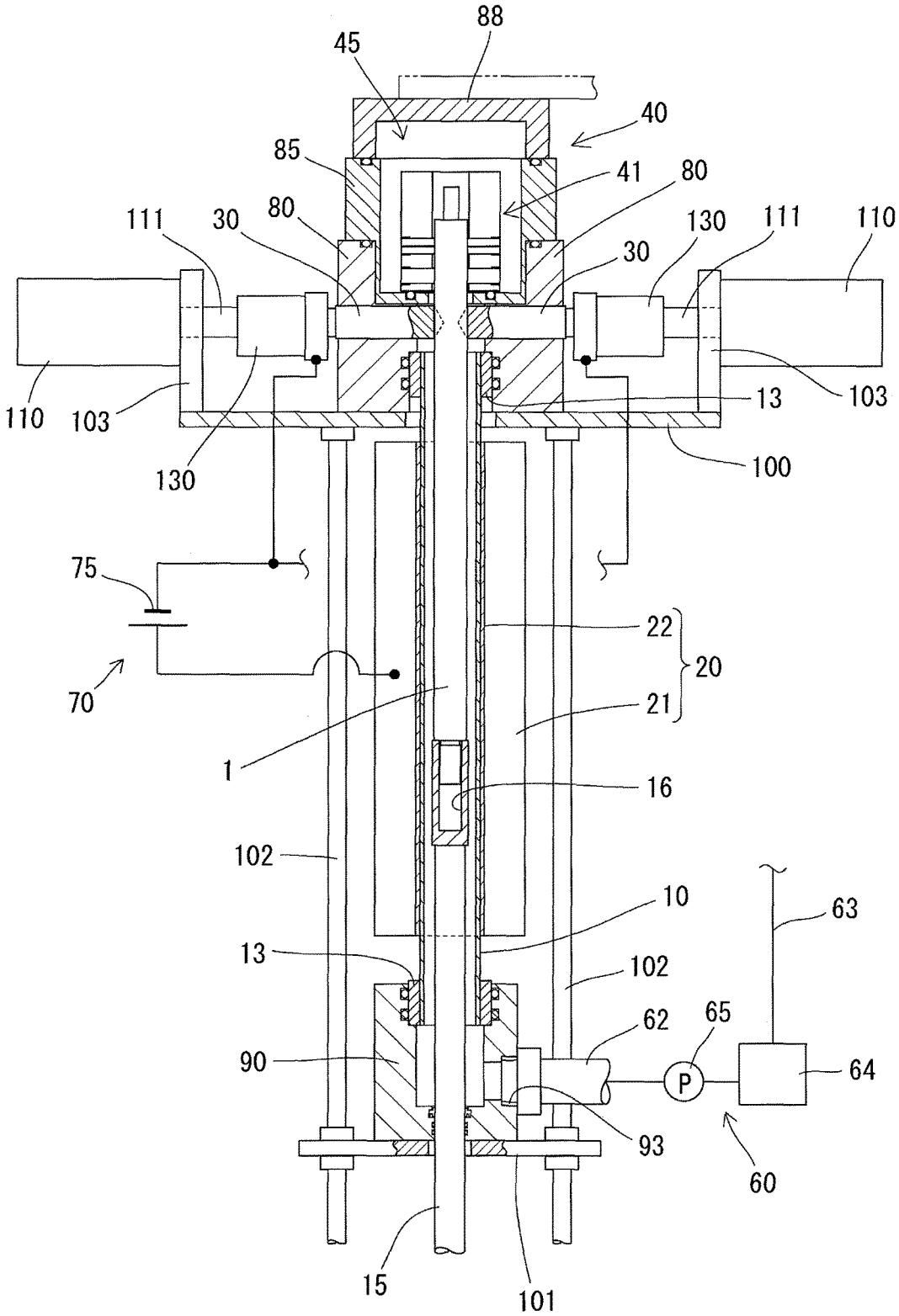
FIG. 1 is a sectional view of a high-speed plating machine taken along a moving direction of a second power-supplying member of the high-speed plating machine according to an embodiment.
Figure 2:
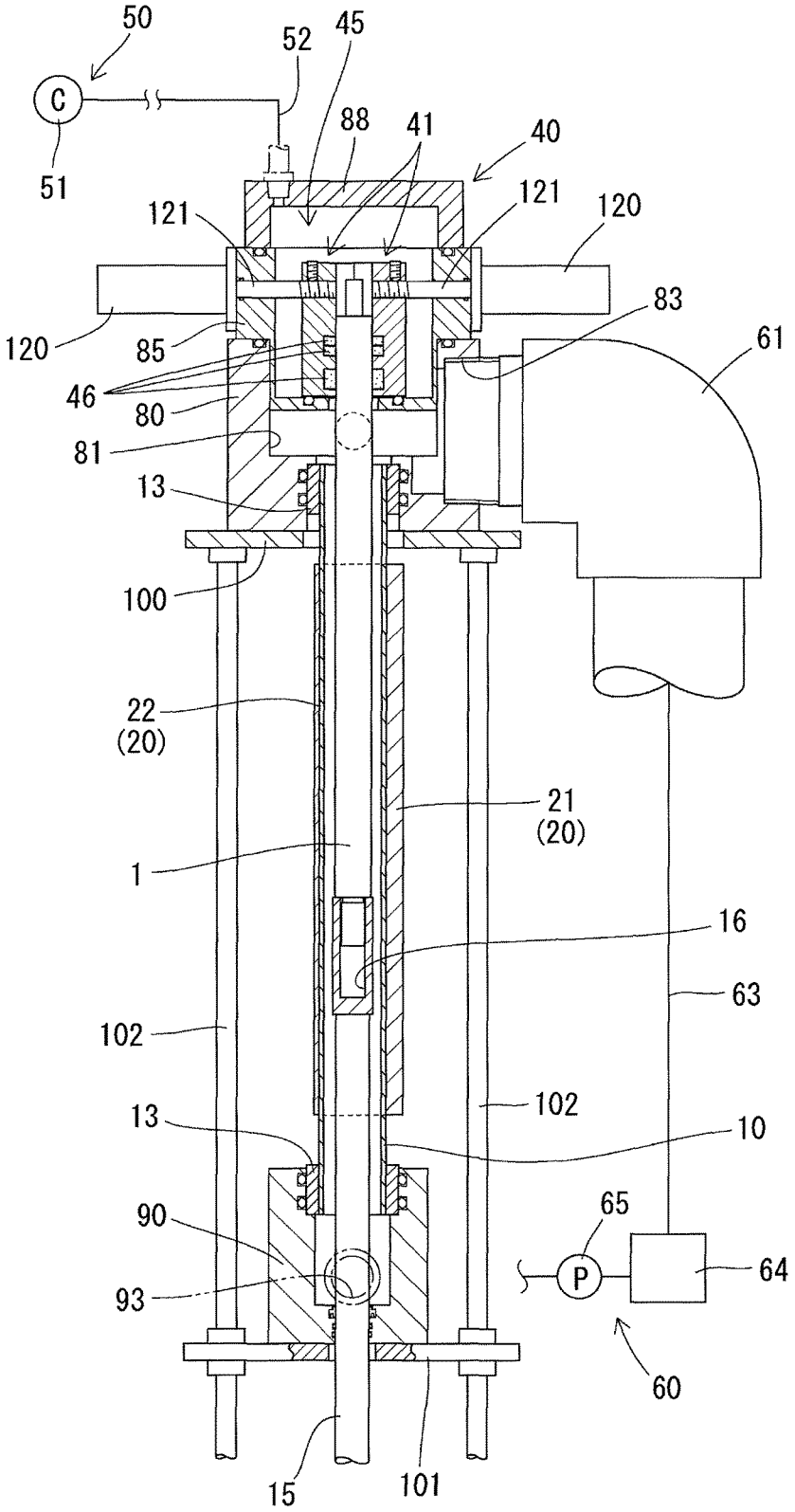
FIG. 2 is a sectional view of the high-speed plating machine taken along a moving direction of a holding member of the high-speed plating machine.

The high-speed plating machine of the embodiment includes an anode 10, a first power-supplying member 20 which is brought into contact with the anode 10 to apply positive voltage to the anode 10, second power-supplying members 30 which are brought into contact with an article 1 to be plated serving as a workpiece to apply negative voltage to the article 1, a holding device 40 including holding members 41 which hold the article 1, a pressurizing unit 50 supplying air into a holding chamber 45 housing the holding members 41 thereby to pressurize an atmosphere in the holding chamber 45, a circulation unit 60 circulating a plating solution, and a power supply unit 70 energizing the anode 10 and the second power-supplying members 30, as shown in FIGS. 1 and 2.

Figure 3:
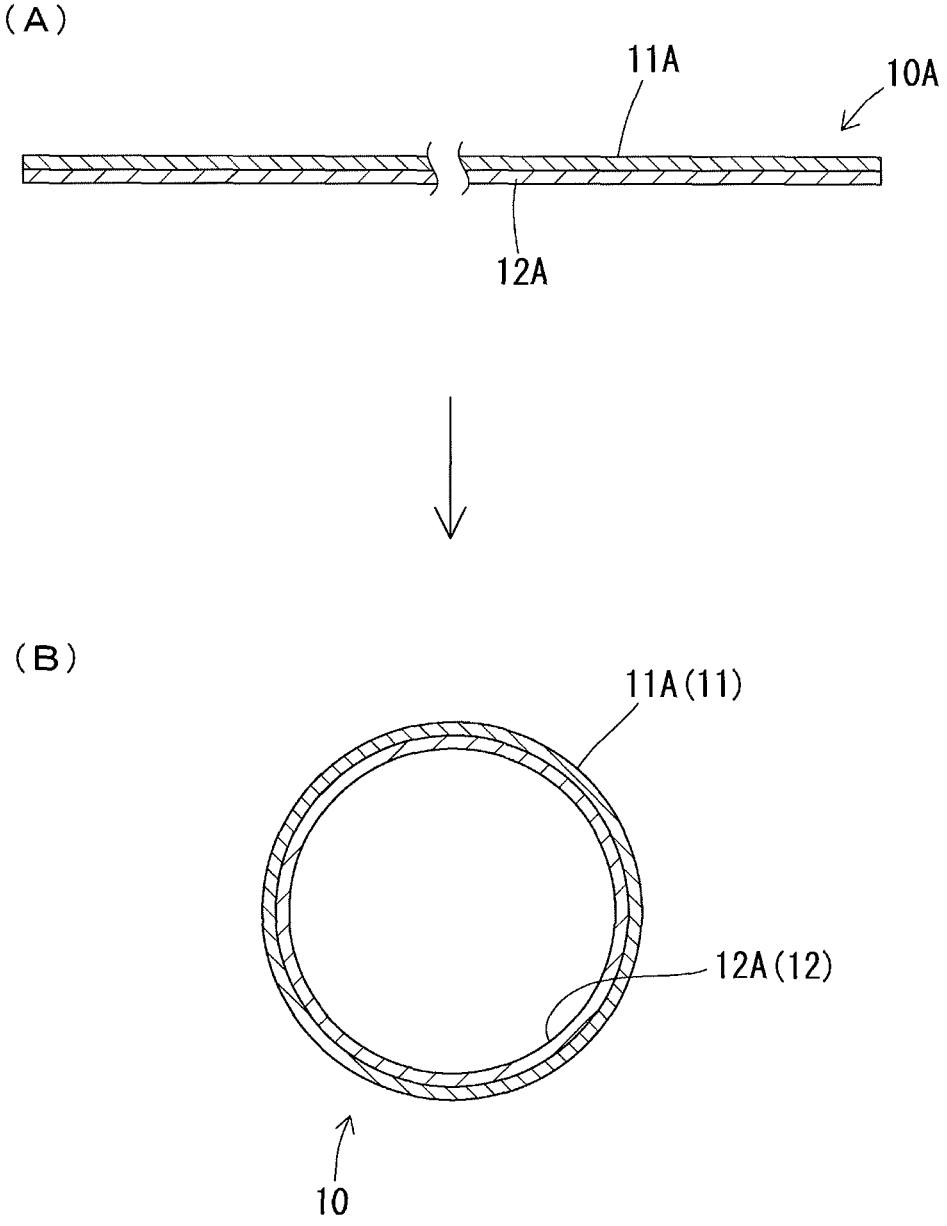
FIGS. 3(A) and 3(B) are, (A) a sectional view of an anode showing a flat plate material made from titanium and a flat plate material made from platinum, both of which are welded together, and (B) a sectional view of the anode made by rounding the plates into a cylindrical shape and butting and welding both ends, respectively.
Figure 4:
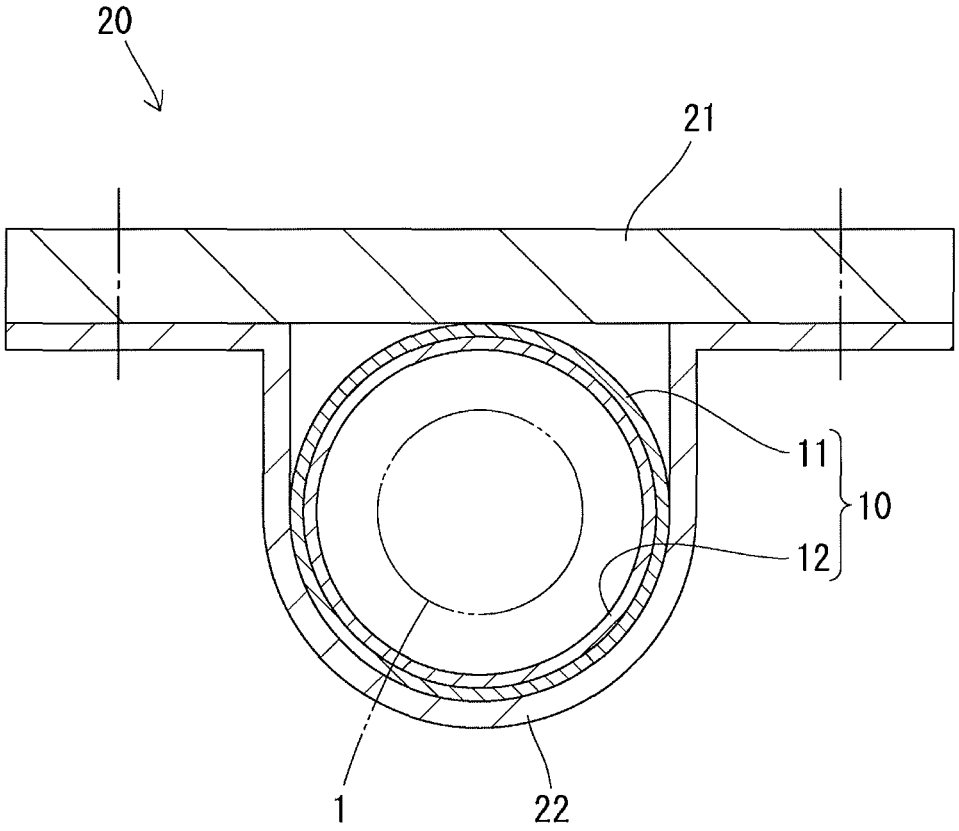
FIG. 4 is a sectional view of the anode and a first power-supplying member.

The anode 10 is cylindrical in shape and is disposed to extend in a vertical direction. The anode 10 has an outer cylinder 11 formed of a plate material made from titanium and an inner cylinder 12 formed of a plate material made from platinum, as shown in FIGS. 3 and 4. The anode 10 also has ring members 13 made from titanium and fitted onto upper and lower ends thereof respectively, as shown in FIGS. 1 and 2.

The anode 10 is manufactured in the following manner. Firstly, a flat plate material 12A made from platinum is overlapped with a flat plate material 11A made from titanium, and the overlapped sides are welded together by electrical resistance welding, so that the plate materials are manufactured into a double structure plate material 10A (see FIG. 3 (A)). Next, the double structure plate material 10A is rounded with the platinum plate material 12A being located inside and then shaped into a cylindrical shape. Both end faces of the material 10A are butted with each other and welded together (see FIG. 3 (B)). The ring members 13 are welded onto outer peripheries of upper and lower ends of the anode 10 thereby to be integrated with the anode 10.

Since the inner cylinder 12 comprised of the platinum plate material 12A is welded onto an inner periphery of the electrically conductive outer cylinder 11 made from titanium thereby to be formed into the anode 10, the inner cylinder 12 comprised of the platinum plate material 12A can be attached firmly to the electrically conductive outer cylinder 11. This can reduce peel-off of the inner cylinder 12 comprised of the platinum plate material 12A from the inner periphery of the outer cylinder 11 during the plating process. Further, since the inner cylinder 12 is formed of the platinum plate material 12A, an amount of wear of platinum caused by electrical plating can be rendered smaller than a thin film of electrodeposited platinum. This can reduce a replacement frequency of the anode 10 and additional processing costs.

Accordingly, the anode 10 and the high-speed plating machine provided with the anode 10 can perform plating in good condition for a long period of time.

Further, the anode 10 is formed by overlapping the flat platinum plate material 12A with the flat titanium plate material 11A and thereafter by butting the end surfaces with each other and welding the end surfaces together. As a result, the cylindrical anode 10 can easily be formed which is comprised of the outer cylinder 11 formed of the flat titanium plate material 11A and the inner cylinder 12 formed of the flat platinum plate material 12A.

The first power-supplying member 20 is formed of a first member 21 and a second member 22 both of which are attached to apart of the anode 10 located between the ring members 13 fitted on the upper and lower ends of the anode 10, as shown in FIGS. 1, 2 and 4. The first member 21 may be a copper plate, and the second member 22 maybe a copperplate having a smaller thickness than the first member 21. The first member 21 may be a longitudinally long rectangular flat plate extending in an up-down direction along the anode 10. The first member 21 has a horizontal middle part brought into contact with the outer periphery of the anode 10 extending vertically linearly. The second member 22 may have two ends abutting against the first member 21 and may be a longitudinally long rectangular flat plate extending in an up-down direction along the anode 10. The ends of the second member 22 are bolted to the first member 21 by a plurality of bolts. The second member 22 has a middle part which is swollen frontward into a U shape so as to cover the anode 10 in a state where the second member 22 is bolted to the first member 21. The second member 22 also has an inner surface brought into contact with a half circumferential surface of the anode 10 which is located away from the first member 21. The anode 10 can be detached and thereby can be replaced by loosening the bolts fastening the first and second members 21 and 22.

The anode 10 has an upper end supported by an upper receiving member 80 and a lower end supported by a lower receiving member 90, as shown in FIGS. 1 and 2. The upper receiving member 80 is fixed to a flat plate-shaped first fixing member 100 having an opening through which the anode 10 is inserted. The lower receiving member 90 is fixed to a flat plate-shaped second fixing member 101 having an opening through which a support rod 15 which will be described later is inserted. The second fixing member 101 is connected to four connecting members 102 extending downward from an underside of the first fixing member 100, so as to be located below the first fixing member 100.

Figure 5:
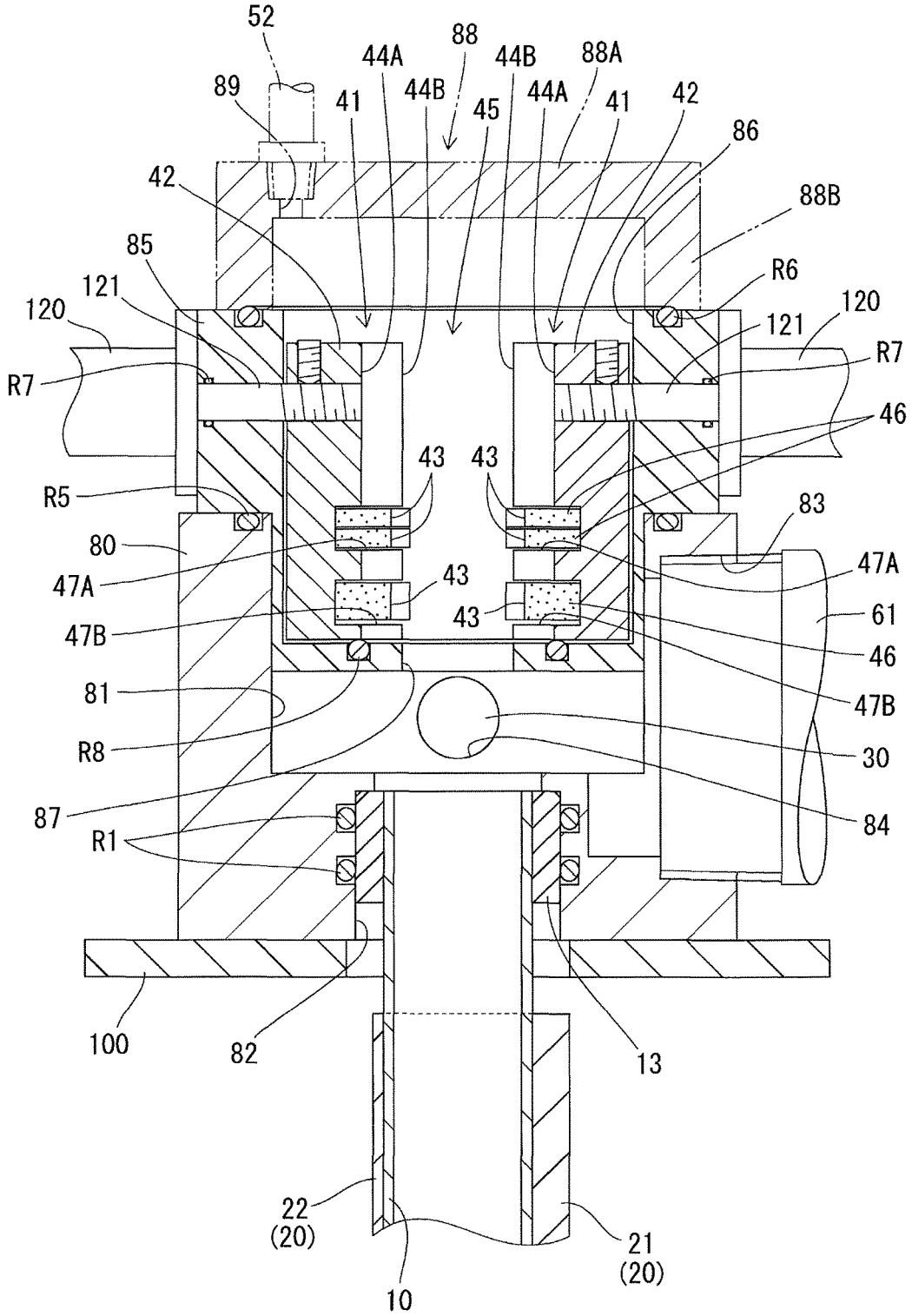
FIG. 5 is an enlarged sectional view of a part of the high-speed plating machine located above an upper part of the anode.

The upper receiving member 80 has an outer shape of rectangular parallelepiped and includes an upper space 81 open vertically upward and a lower space 82 continuous from a lower end of the upper space 81 and open vertically downward, as shown in FIG. 5. The upper and lower spaces 81 and 82 have respective inner peripheries which are concentrically circular in horizontal cross-section. A base member 85 which will be described later has a lower part inserted into the upper space 81 from above. Two second power-supplying members 30 are aligned and have respective distal ends which are opposed to each other in a part of the upper space 81 located below the base member 85. The second power-supplying members 30 are disposed to be movable toward and away from a center of the upper space 81. The upper space 81 has a plating solution outlet 83 extending continuously horizontally thereby to be open in a side surface of the upper receiving member 80, as shown in FIGS. 2 and 5. A generally L-shaped outflow pipe 61 is connected to the plating solution outlet 83.

The upper end of the anode 10 on which the ring member 13 is fitted is inserted into the lower space 82 of the upper receiving member 80, as shown in FIGS. 1, 2 and 5. Two corrosion-resistant O-rings R1 are interposed between an inner periphery of the lower space 82 and an outer periphery of the ring member 13. As a result, the plating solution can be prevented from leaking through a connection of the lower space 82 of the upper receiving member 80 and the anode 10.

Figure 6:
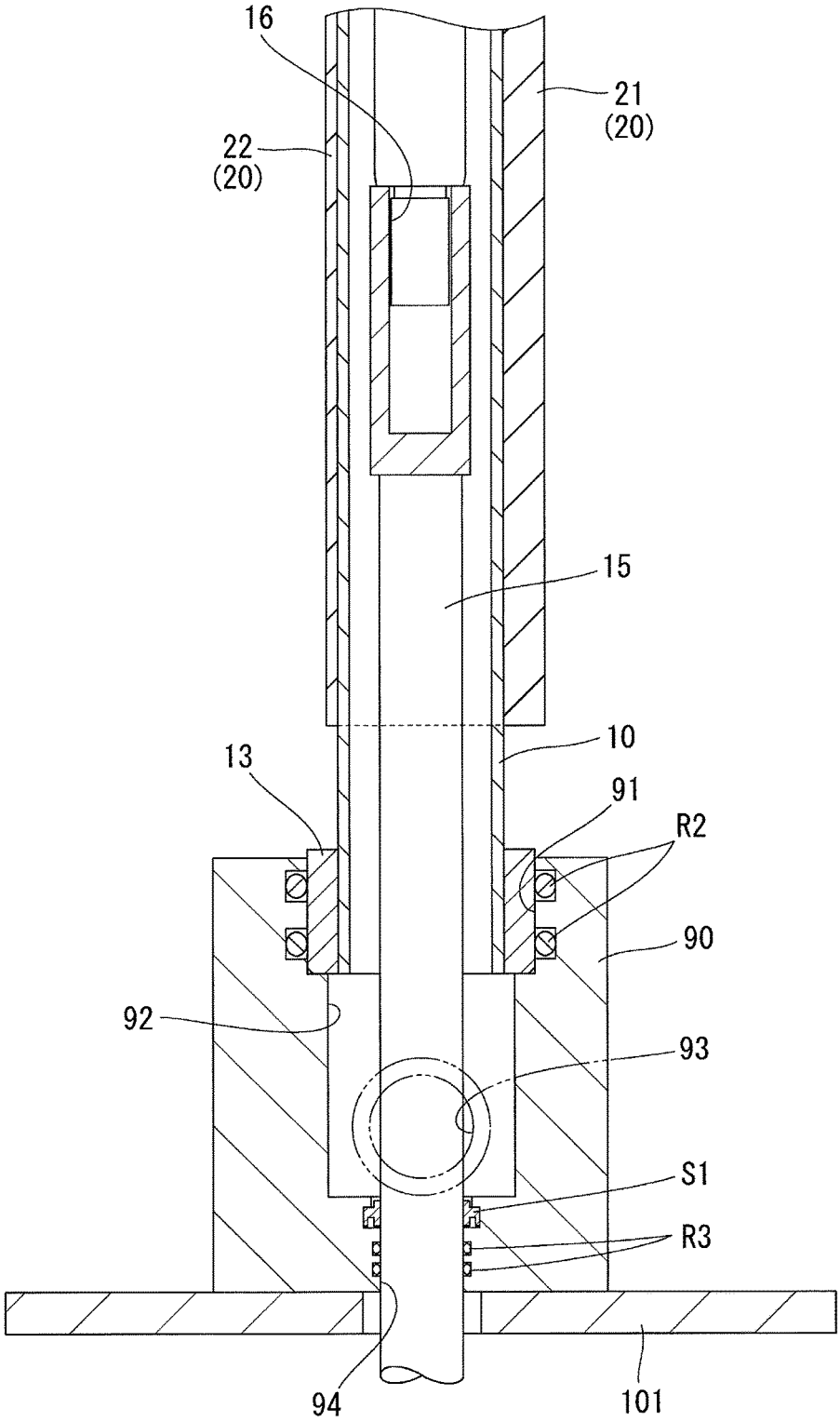
FIG. 6 is an enlarged sectional view of a lower receiving member supporting a lower part of the anode and the periphery of the lower receiving member.

The lower receiving member 90 has an outer shape of rectangular parallelepiped and includes an upper space 91 open vertically upward and a lower space 92 continuous from a lower end of the upper space 91, as shown in FIG. 6. The upper and lower spaces 91 and 92 have respective inner peripheries which are concentrically circular in horizontal cross-section. The lower end of the anode 10 on which the ring member 13 is fitted is inserted into the upper space 91. Two corrosion-resistant O-rings R2 are interposed between an inner periphery of the upper space 91 and an outer periphery of the ring member 13. As a result, the plating solution can be prevented from leaking through a connection of the upper space 91 of the lower receiving member 90 and the anode 10.

The lower space 92 of the lower receiving member 90 has a plating solution inlet 93 extending continuously in a horizontal direction and open in a side surface of the lower receiving member 90, as shown in FIGS. 1, 2 and 6. An inflow pipe 62 is connected to the plating solution inlet 93. Further, the lower space 92 also has an insertion hole 94 extending continuously vertically downward and open in a lower end surface of the lower receiving member 90. The insertion hole 94, the lower space 92 and the upper space 91 have respective inner peripheries which are concentrically circular in horizontal cross-section. A columnar support rod 15 is inserted through the insertion hole 94 so as to be movable upward and downward.

The support rod 15 has an upper end with a recess 16 open upward. A lower end of the columnar article 1 to be plated is inserted into the recess 16. The support rod 15 also has a lower end which is connected to a piston rod of an air cylinder (not shown). Accordingly, the support rod 15 can be moved upward and downward on a central axis of the anode 10 by driving the air cylinder. Two corrosion-resistant O-rings R3 and a dust seal S1 are interposed between an inner periphery of the insertion hole 94 and the support rod 15. This can prevent dust from entering inside from the outside as well as the plating solution from leaking through a gap between the insertion hole 94 and support rod 15.

Figure 7:
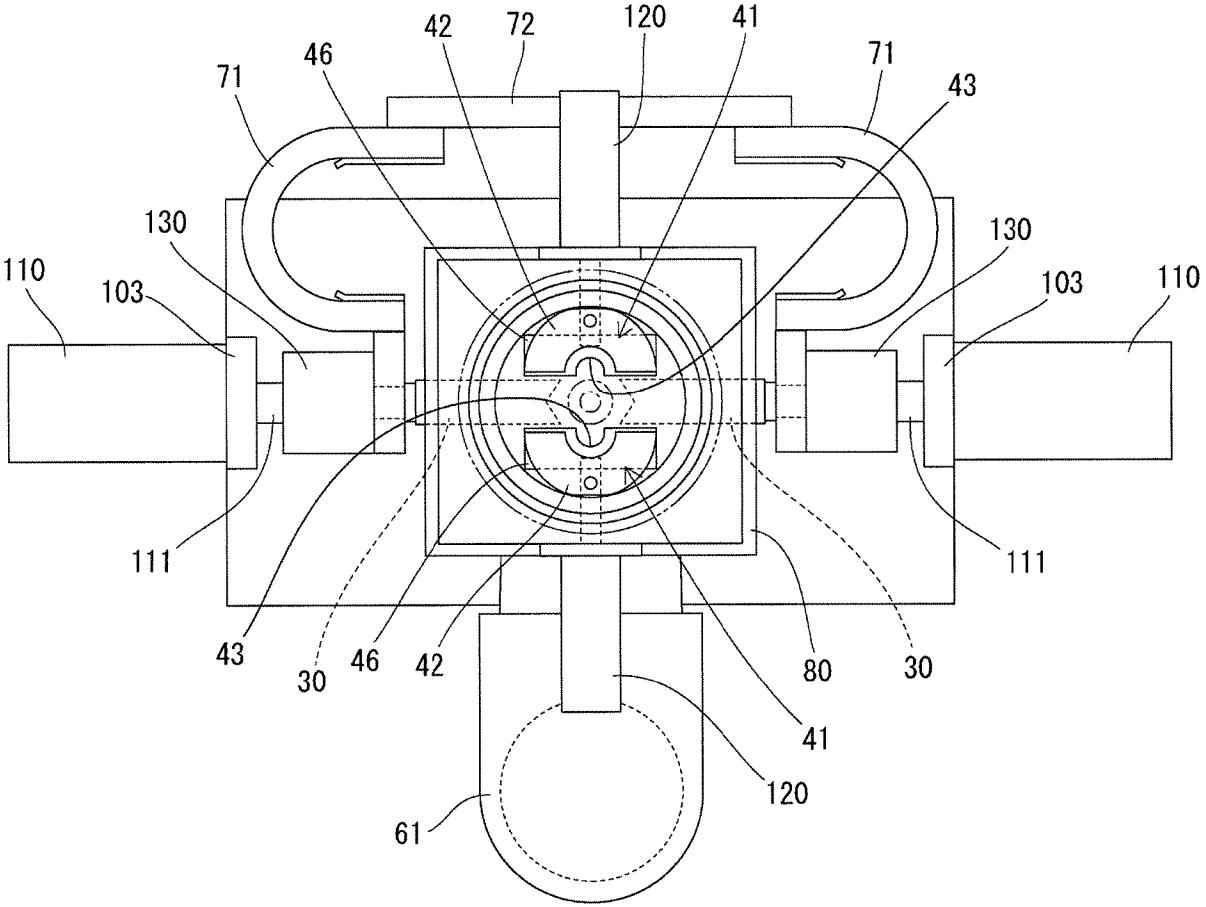
FIG. 7 is a top plan view of the high-speed plating machine.
Figure 8:
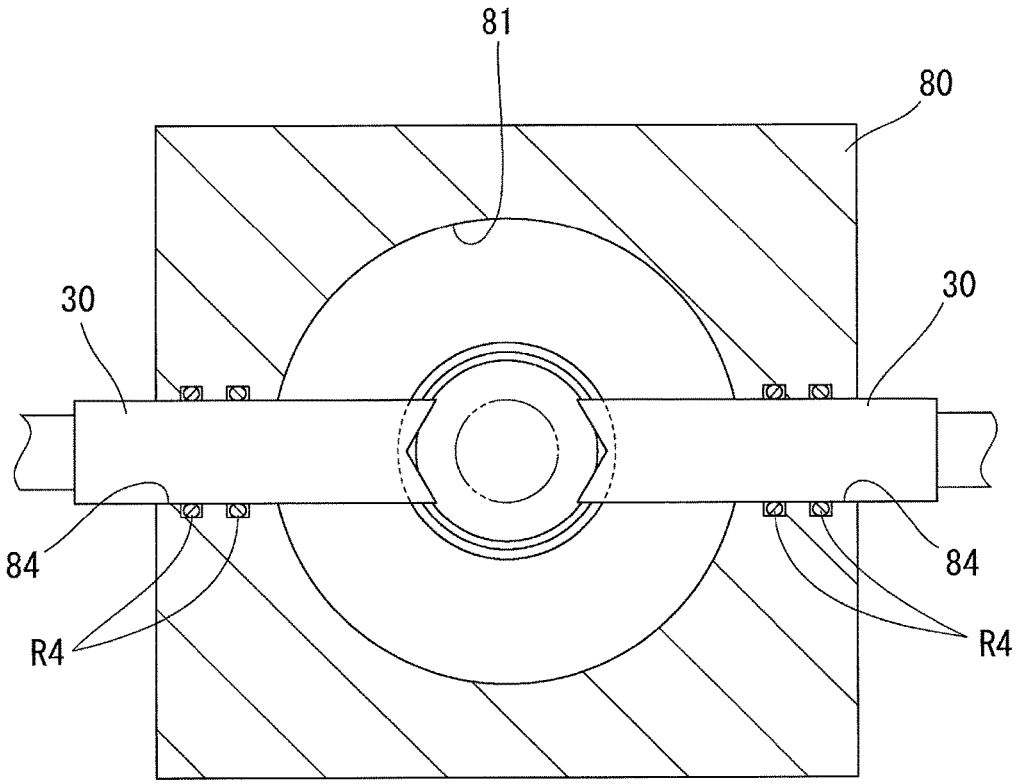
FIG. 8 is a horizontal sectional view of a part of the high-speed plating machine, showing second power-supplying members.

The upper receiving member 80 has two opposed sides through each one of which two through holes 84 extend linearly toward the upper space 81, as shown in FIGS. 1 and 8. The second power-supplying members 30 are inserted into the through holes 84 respectively. The second power-supplying members 30 are aligned as described above and have respective distal ends opposed to each other in a part of the upper space 81 located below the base member 85. The second power-supplying members 30 have rear ends which are located outside the side surfaces of the upper receiving member 80 and are connected via gripping members 130 to piston rods 111 of air cylinders 110, respectively, as shown in FIG. 7. The air cylinders 110 are fixed to fixing walls 103 standing from both ends of the first fixing member 100 respectively. Accordingly, the second power-supplying members 30 are movable forward toward and backward away from the center of the upper space 81 by driving the air cylinders 110. More specifically, the second power-supplying members 30 are movable between respective forward positions toward the article 1 disposed at the center of the upper space 81 and respective backward positions away from the article 1. The second power-supplying members 30 have distal ends which are brought into contact with the outer periphery of the article 1 when located at the forward positions, respectively. The distal ends of the second power-supplying members 30 are moved away from the outer periphery of the article 1 when located at the respective backward positions. Substantially U-shaped power-supply plates 71 each made from copper have one ends which are connected to the gripping members 130 holding the rear ends of the second power-supplying members 30, respectively. The power-supply plates 71 have the other ends connected to each other by a copper-made connecting plate 72. The power-supply plates 71 are deformable to follow the forward or backward movement of the respective second power-supplying members 30. The power-supply plates 71 are further connected to a power supply 75.

Each one of the second power-supplying members 30 is formed into a columnar shape and has a forward/backward movement direction corresponding to an axial direction thereof. Two corrosion-resistant O-rings R4 are interposed between the outer periphery of each power-supplying member 30 and an inner periphery of each through hole 84, as shown in FIG. 8. As a result, each second power-supplying member 30 can smoothly be moved forward and backward with the plating solution being prevented from leaking through a gap between each second power-supplying member 30 and the upper space 81 of the upper receiving member 80.

Figure 9:
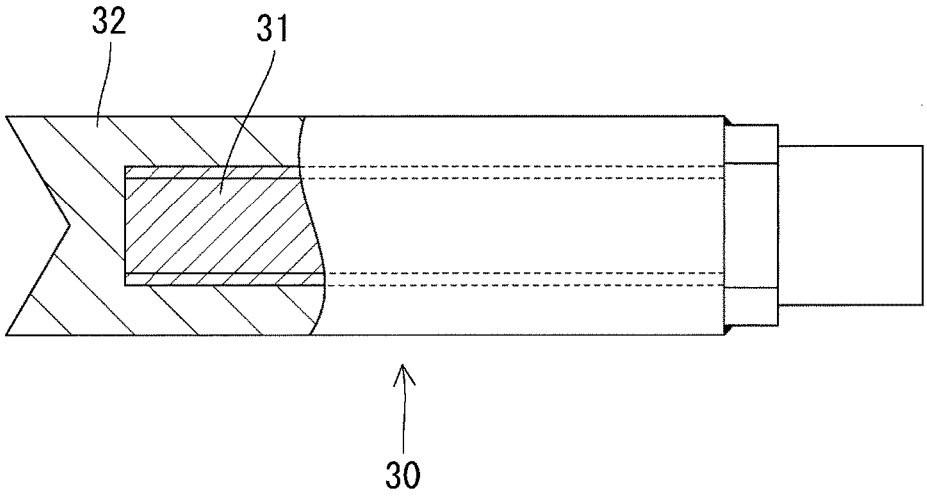
FIG. 9 is a partial sectional view of the second power-supplying member.

Each second power-supplying member 30 has a distal end notched into a V shape such that a middle part thereof or a valley of the V shape is located backward relative to both sides thereof in a planar view, as shown in FIGS. 7 to 9. Each second power-supplying member 30 includes a columnar center member 31 made from copper and a covering member 32 made from titanium and covering a periphery of the center member 31, as shown in FIG. 9. The center member 31 has a diameter ranging from 90% to 50% of an outer diameter of the covering member 32. Since a part of the upper space 81 located below the base member 85 is filled with the plating solution, a part of each second power-supplying member 30 wetted with the plating solution is covered with the titanium covering member 32. Accordingly, each second power-supplying member 30 has an improved corrosion resistance to the plating solution. Consequently, the replacement frequency of the second power-supplying member 30 can be reduced. Further, since each second power-supplying member 30 includes the copper-made center member 31 having a higher electrical conductivity than titanium, each second power-supplying member 30 can suppress heat generation during power supply and can reduce temperature rise of the plating solution as compared with power-supplying members made from only titanium.

Accordingly, the second power-supplying members 30 and the high-speed plating machine provided with the second power-supplying members 30 can perform plating in good condition for a long period of time.

The second power-supplying members 30 will be manufactured as follows. Firstly, as shown in FIG. 9, the inner periphery of the covering member 32 is threaded while a columnar insertion space into which the center member 31 is insertable is defined in the covering member 32. A male thread having the same thread size as the covering member 32 is formed on the center member 31. The center member 31 is then screwed into the insertion space of the covering member 32 and brazed in an insertion hole of the covering member 32, so that the second power-supplying members 30 are manufactured. The center member 31 of each second power-supplying member 30 has a rear end exposed from the covering member 32. The exposed center member 31 is used as an energizing part which is connected to the power supply 75 to energize the second power-supplying members 30 via the gripping member 130.

Figure 10:
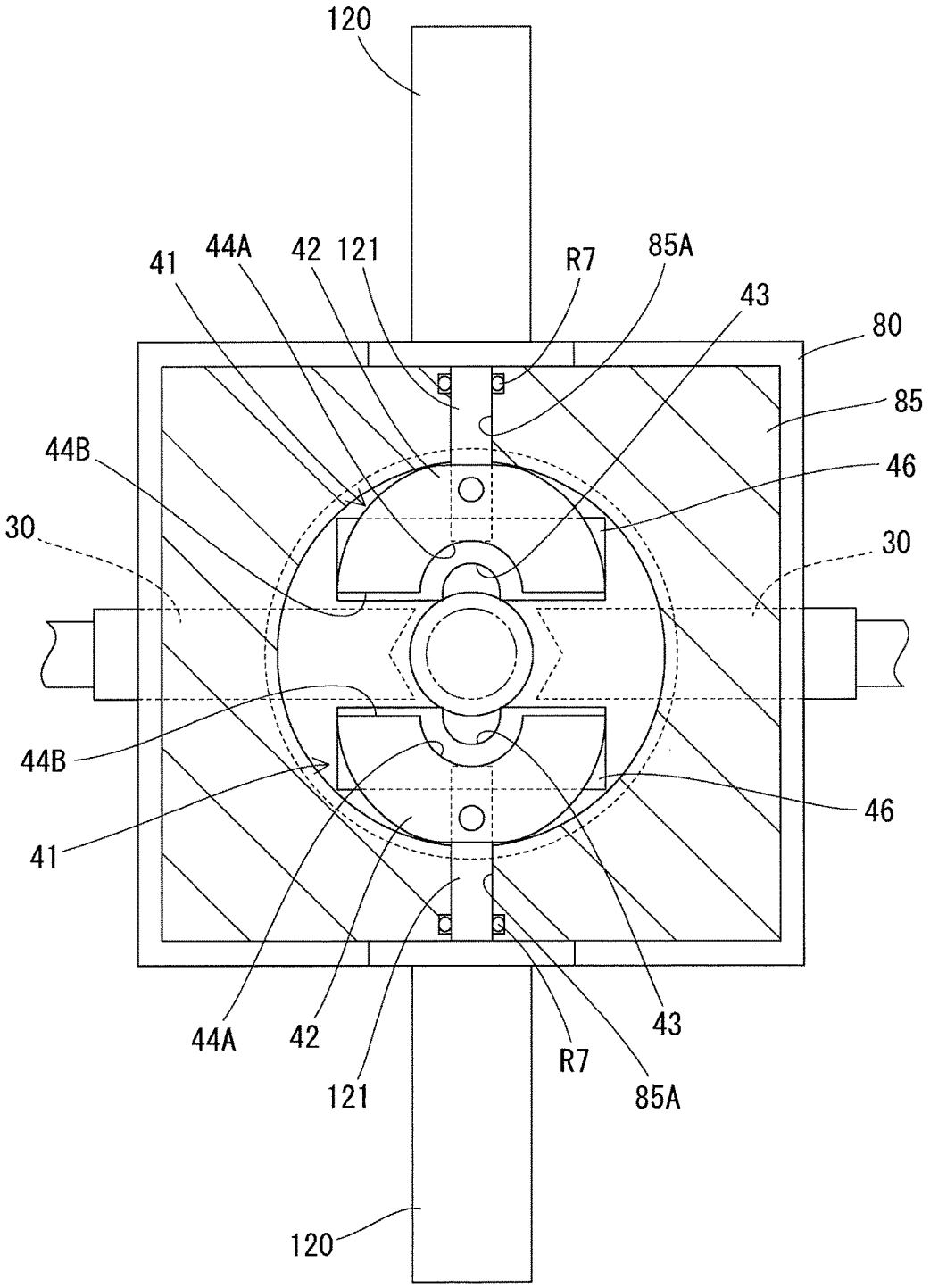
FIG. 10 is a horizontal sectional view of a part of the high-speed plating machine, showing the holding member.

The holding device 40 has a base member 85 including a lower part inserted into the upper space 81 of the upper receiving member 80 from above, as shown in FIGS. 2, 5 and 10. The lower part of the base member 85 has a columnar outer shape. The base member 85 further includes an upper part having an outer shape which is a rectangular parallelepiped shape. The upper receiving member 80 also has an outer shape which is a rectangular parallelepiped shape, and the upper receiving member 80 and the base member 85 are combined with each other so that four sides forming respective peripheral edges are parallel with each other, in a planar view as viewed from above. A corrosion-resistant O-ring R5 is interposed between an upper surface of the upper receiving member 80 and a surface of the base member 85 spreading horizontally from an upper end of a lower part of the base member 85. This can prevent the plating solution from leaking through a gap between the upper receiving member 80 and the base member 85.

The base member 85 has a housing part 86 which is open vertically upward and has a central lower part with a communication hole 87 open vertically downward. The housing part 86 and the communication hole 87 have respective inner peripheries which are concentrically circular in horizontal cross-section. The communication hole 87 has a diameter which is smaller than that of the inner periphery of the communication hole 87 and slightly larger than that of the article 1 to be plated, so that the article 1 can be inserted through the communication hole 87.

The housing part 86 houses a pair of holding members 41. A holding chamber 45 is thus defined by the housing part 86 of the base member 85 and a seal cover 88 closing an upper part of the base member 85. The seal cover 88 has a disc-shaped upper surface 88A and a side surface 88B extending downward from a peripheral edge of the upper surface 88A. The upper surface 88A has an air inlet 89 extending therethrough. An air tube 52 has one of two ends which is connected to the air inlet 89 and the other end which is connected to a compressor 51. The pressurizing unit 50 thus includes the compressor 51 and the air tube 52. The seal cover 88 can be moved by a moving apparatus (not shown) to a position where the upper opening of the base member 85 is closed by the seal cover 88, at which position the seal cover 88 is downwardly pressed. An O-ring R6 is interposed between the upper surface of the base member 85 and undersides of side surfaces of the seal cover 88. This can prevent air from leaking through a gap between the base member 85 and the seal cover 88.

The holding members 41 include holding member bodies 42 and abutting parts 43 respectively. Each holding member body 42 is formed into a shape of semicircular column and includes a middle part which extends along an axis of flat surface and forms a recess 44A recessed into a semicircular column shape . The recess 44A is formed to be larger than the outer diameter of the columnar article 1 to be plated. The holding member bodies 42 are disposed so that the flat surfaces 44B are opposed to each other.

Each abutting part 43 is formed of a sponge sheet 46 which is formed into a rectangular shape in a planar view as viewed from above, as shown in FIG. 10. The sponge sheet 46 is an elastic body with chemical resistance. The sponge sheet 46 has a middle part of a longer side formed with the semicircular notch which serves as the abutting part 43. Each abutting part 43 has a diameter smaller than the outer diameter of the columnar article 1 to be plated and abuts against the outer periphery of the article 1. More specifically, each abutting part 43 is formed by cutting out the sponge sheet 46 into a similar figure which is smaller than a side geometry of the article 1. As a result, the abutting part 43 can closely abut against the outer periphery of the article 1.

The holding member bodies 42 have respective sides which are opposed to each other and are each formed with two grooves 47A and 47B which extend horizontally at two locations spaced away from each other in a heightwise direction in order to hold the sponge sheet 46 therein, as shown in FIG. 5. Two thin sponge sheets 46 are inserted into each one of the upper grooves 47A thereby to be held therein. A thick sponge sheet 46 is inserted into each one of the lower grooves 47B thereby to be held therein.

The base member 85 has two sides perpendicular to sides of the upper receiving member 80, into which sides the second power-supplying members 30 are inserted, respectively, as shown in FIG. 10. Air cylinders 120 are mounted on the two sides of the base member 85 respectively. The base member 85 has two through holes 85A which extend through the two sides thereof into the housing part 86 and through which piston rods 121 of the air cylinders 120 are inserted, respectively. Two O-rings R7 are interposed between inner peripheries of the insertion holes 85A and outer peripheries of the piston rods 121 respectively. As a result, air can be prevented from leaking through gaps between the insertion holes 85A and the piston rods 121 respectively.

The piston rods 121 of the air cylinders 120 have distal ends which are connected to the holding member bodies 42 in the holding chamber 45 of the base member 85, respectively. The holding members 41 are configured to be movable between respective backward positions and forward positions. When the holding members 41 are located at the respective backward positions, respective flat surfaces 44B of the holding member bodies 42 and respective end surfaces of the sponge sheets 46 are separated from each other, and parts of arc-shaped sides of the holding member bodies 42 are in abutment against the inner periphery of the base member 85. When the holding members 41 are located at the respective forward positions, the opposed end surfaces of the sponge sheets 46 are in contact with each other, and the abutting parts 43 of the sponge sheets 46 closely abut against respective portions of the outer periphery of the article 1 at the same level from both sides of the article 1 thereby to hold the article 1 therebetween.

A corrosion-resistant O-ring R8 is interposed between the underside of the holding member body 42 and the bottom of the housing part 86 of the base member 85, as shown in FIG. 5. As a result, the plating solution can be prevented from leaking through gaps between the holding member bodies 42 and the base member 85.

The circulation unit 60 includes a circulation path 63, a plating solution control tank 64 and a pump 65 as shown in FIGS. 1 and 2. The circulation path 63 has a generally L-shaped outlet pipe 61 connected to the plating solution outlet 83 open to the side surface of the upper receiving member 80 and an inlet pipe 62 connected to the plating solution inlet 93 open to the side surface of the lower receiving member 90. The plating solution control tank 64 and the pump 65 are provided in the middle of the circulation path 63. Upon drive of the pump 65, the circulation unit 60 can supply the plating solution in the control tank 64 into the plating solution inlet 93 of the lower receiving member 90 and can thereafter circulate the plating solution through the lower receiving member 90, the anode 10, the upper receiving member 80, and the plating solution outlet 83 sequentially in this order and then return the plating solution into the plating solution control tank 64.

The power supply unit 70 includes the power supply 75 which is connected so as to apply positive voltage to the anode 10 via the first power-supplying member 20 and so as to apply negative voltage to the article 1 to be plated via the second power-supplying members 30, as shown in FIG. 1.

A plating process performed by the high-speed plating machine thus constructed will now be described as follows.

Figure 11:
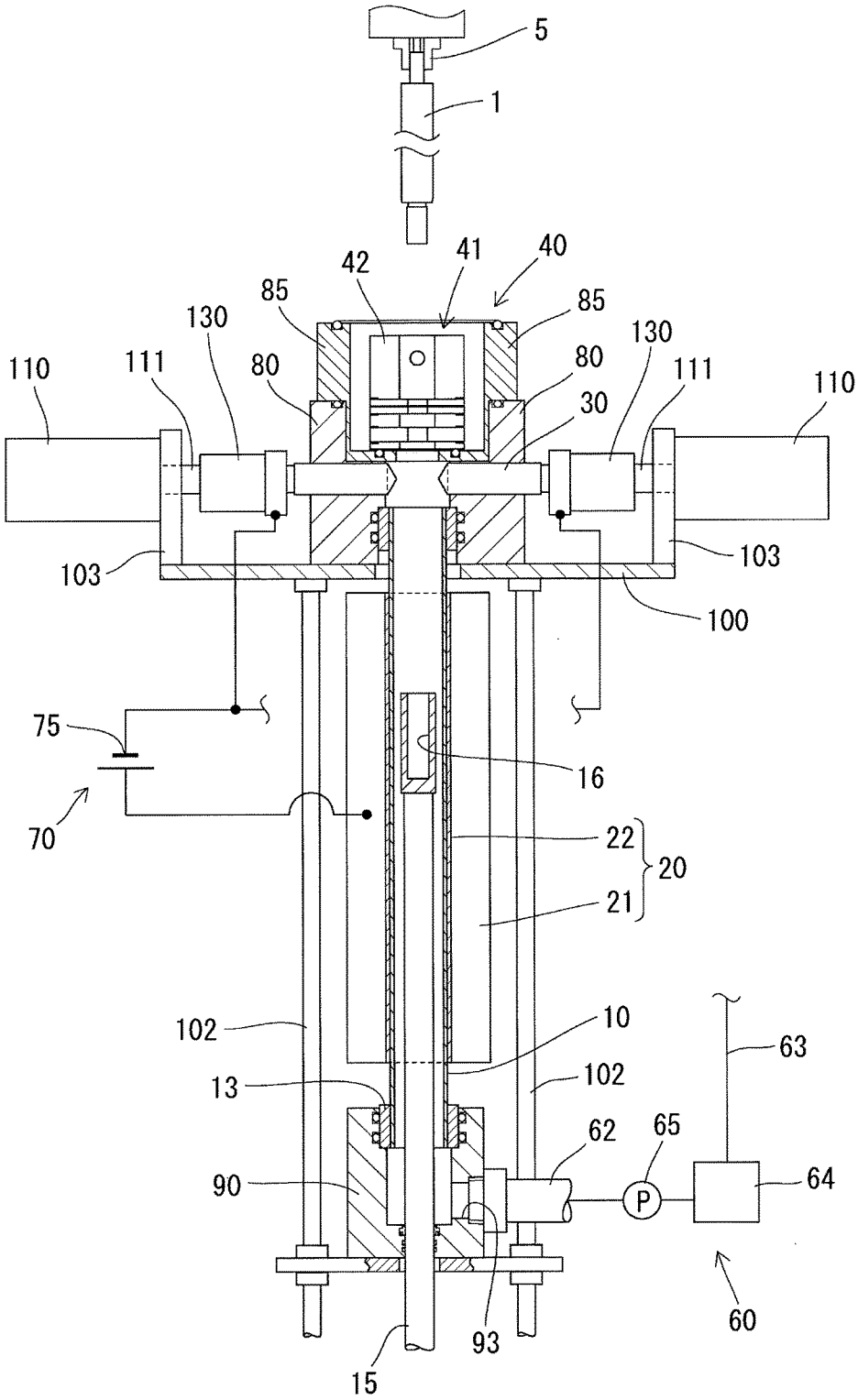
FIG. 11 is a sectional view of the high-speed plating machine taken along the moving direction of the second power-supplying members, showing the state before an article to be plated is lowered into the anode.
Figure 12:
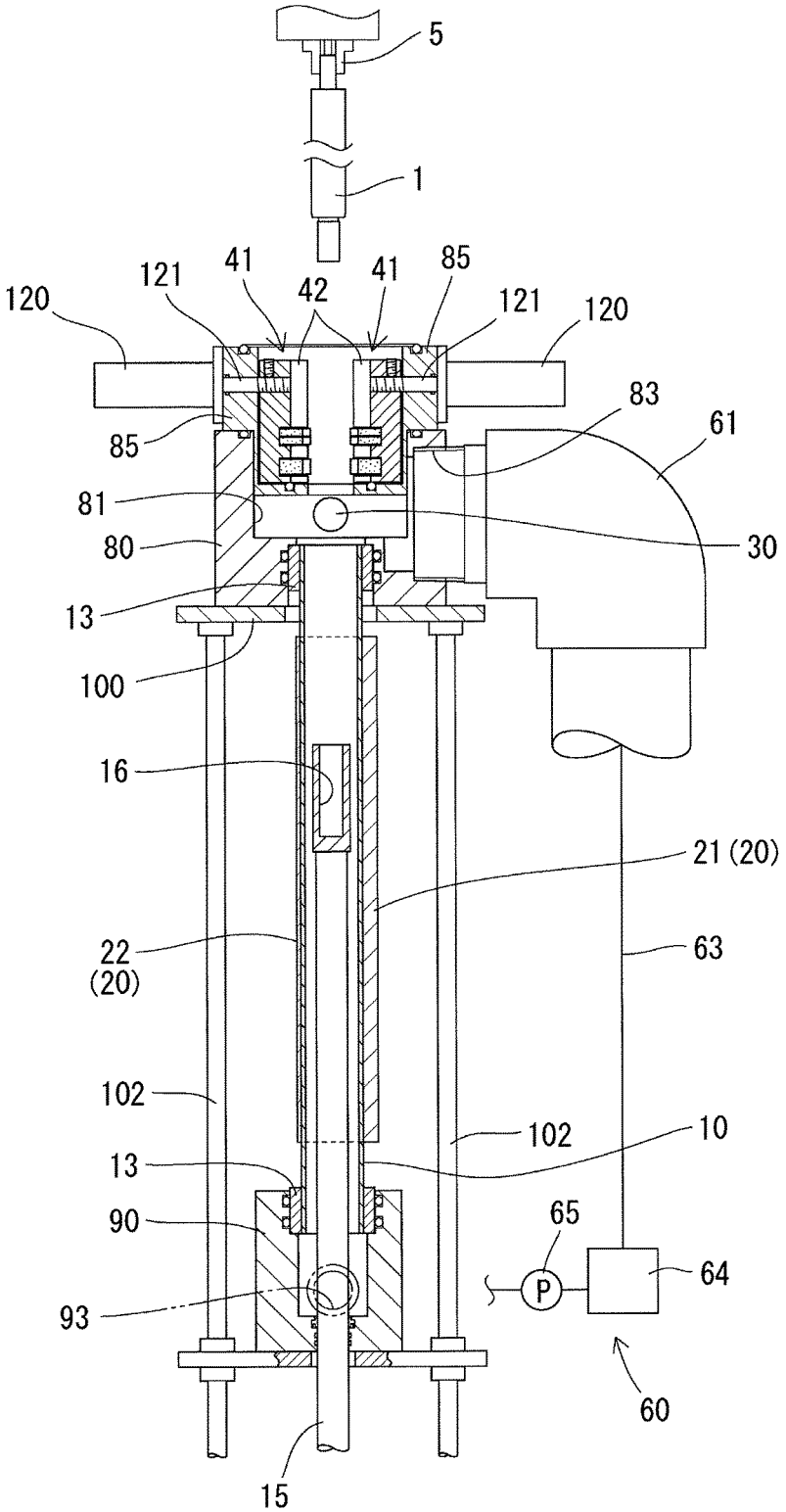
FIG. 12 is a sectional view of the high-speed plating machine taken along the moving direction of the holding member, showing the state before the article to be plated is lowered into the anode.
Figure 13:
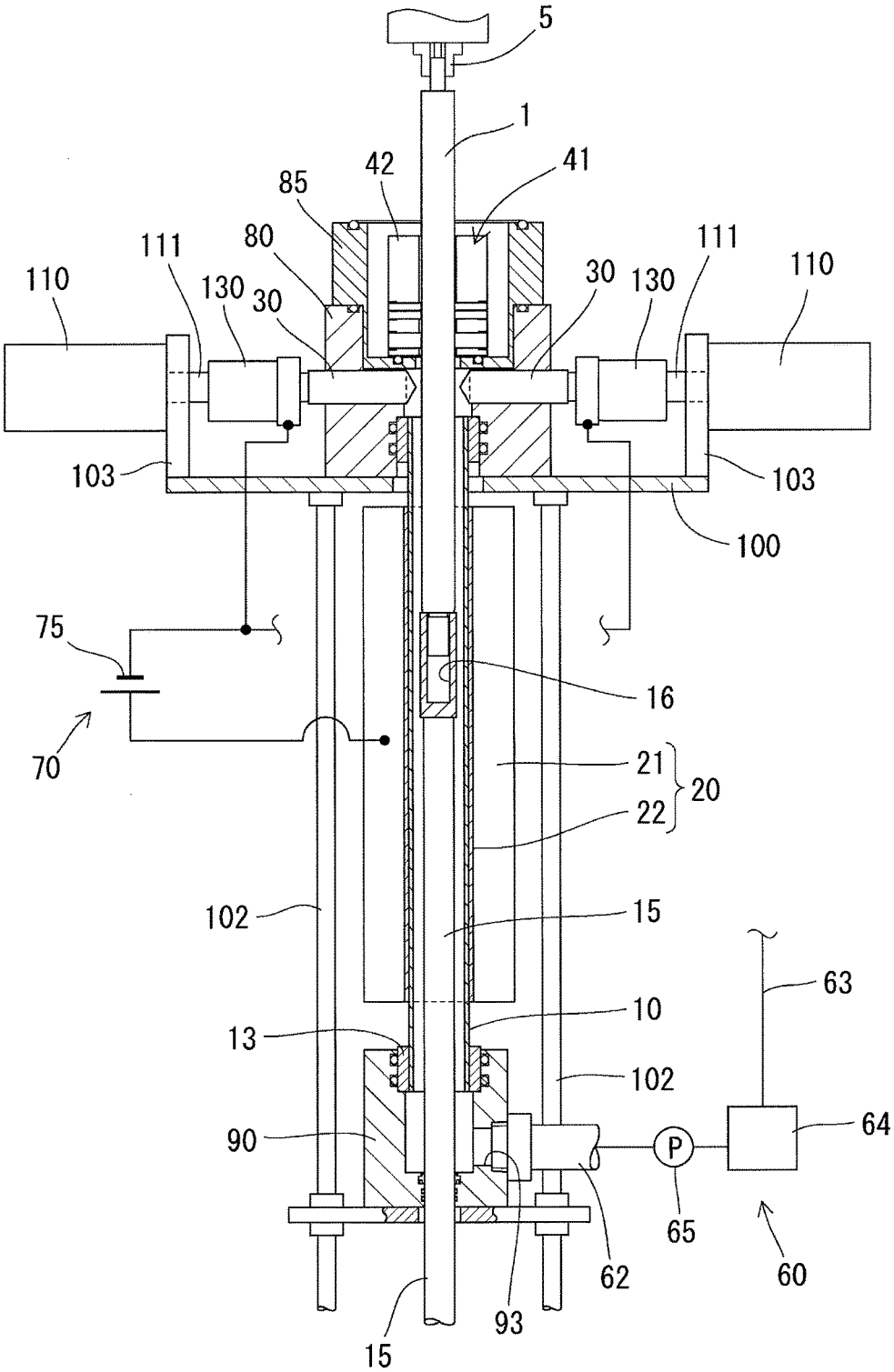
FIG. 13 is a sectional view of the high-speed plating machine taken along the moving direction of the second power-supplying members, showing the state in which a lower end of the article has been inserted into an upper end recess of a support rod.

Firstly, when the second power-supplying members 30 and the holding members 41 are located at the respective backward positions and the support rod 15 is in the raised state, the high-speed plating machine is on standby for the lowering of the article 1 gripped in the upper end thereof by a chuck 5, as shown in FIGS. 11 and 12. The article 1 is lowered from the upper opening of the base member 85, and the lower end of the article 1 is inserted into the recess 16 upwardly open at the upper end of the support rod 15, as shown in FIG. 13.

Further, the piston rod of the air cylinder (not shown) connected to the lower end of the support rod 15 is lowered with the lowering of the chuck 5 gripping the upper end of the article 1, so that the article 1 is lowered to a plating position. More specifically, the article 1 is disposed so that a space in which the plating solution flows is formed between the anode 10 and the article 1.

Figure 14:
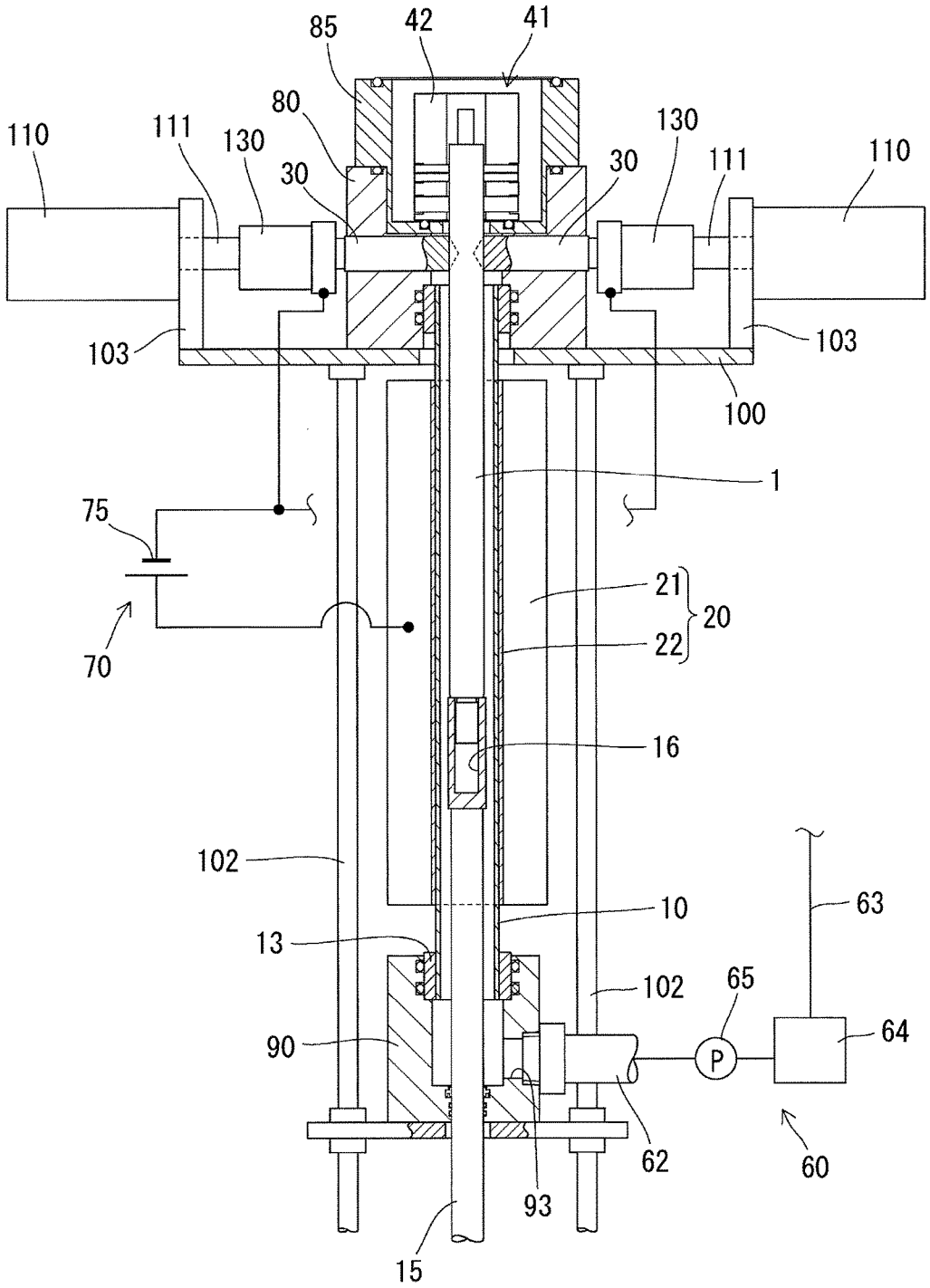
FIG. 14 is a sectional view of the high-speed plating machine taken along the moving direction of the second power-supplying members, showing the state in which the article has been lowered into the anode.
Figure 15:
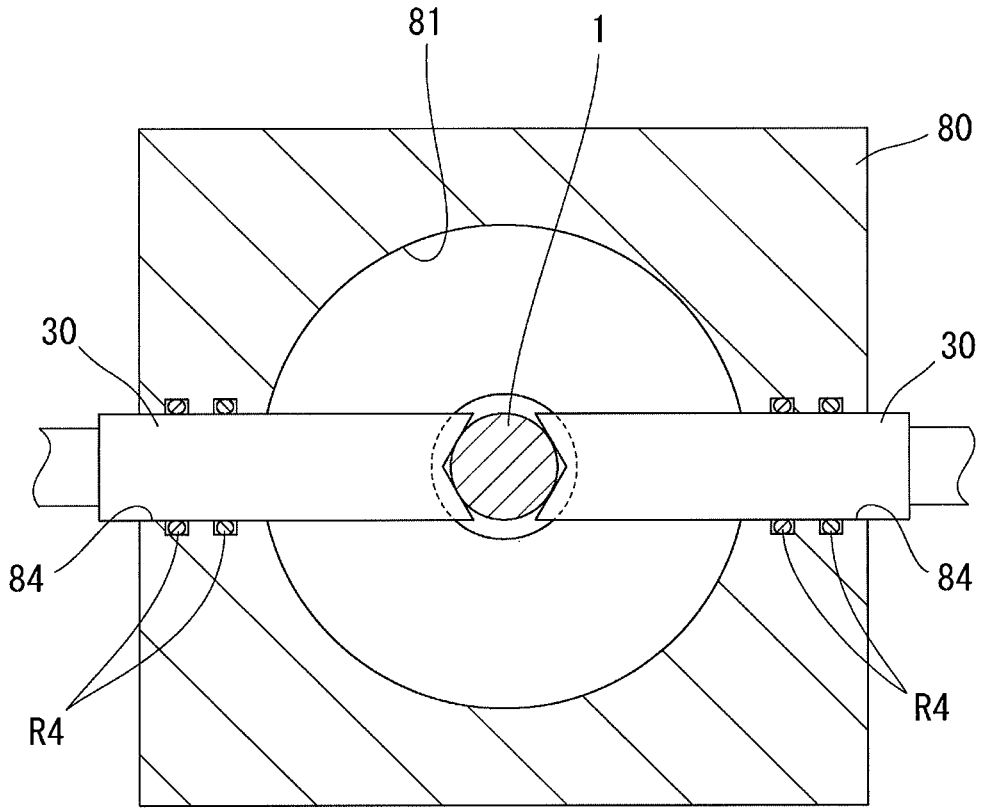
FIG. 15 is a sectional view showing distal ends of the second power-supplying members brought into contact with a periphery of the article.

In this state, the piston rods 111 of the air cylinders 110 are moved forward which are connected via the gripping members 130 to the rear ends of the second power-supplying members 30, respectively. More specifically, the second power-supplying members 30 are moved to the respective forward positions toward the article 1. The distal ends of the second power-supplying members 30 are brought into contact with the upper periphery of the article 1 to hold the article 1, as shown in FIGS. 14 and 15. At this time, the holding members 41 are located at the respective backward positions. The chuck 5 releases the article 1 from the gripped state, being raised upward.

Figure 16:
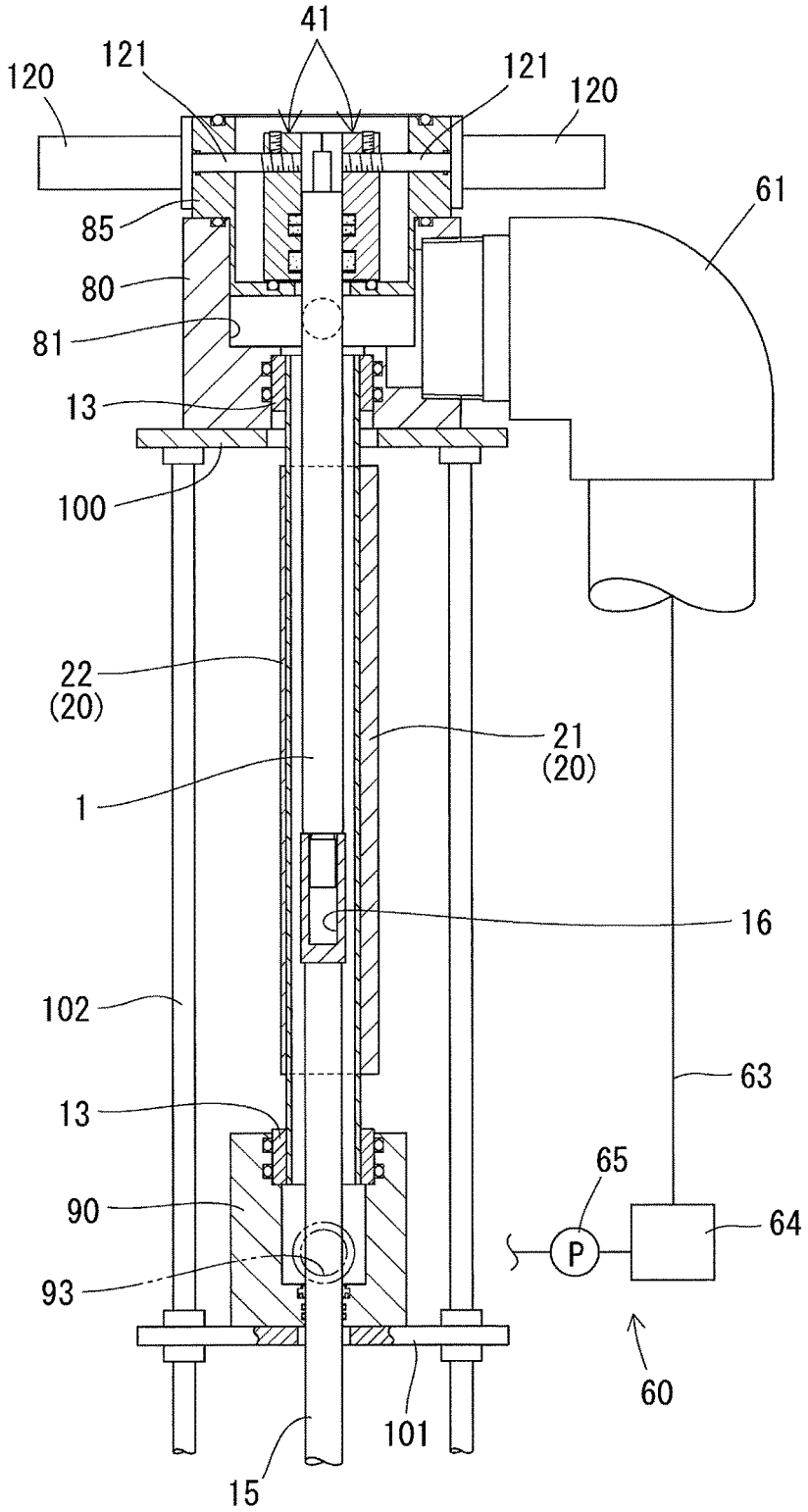
FIG. 16 is a sectional view of the high-speed plating machine taken along the moving direction of the holding member, showing the state in which the article has been held by the holding member.
Figure 17:
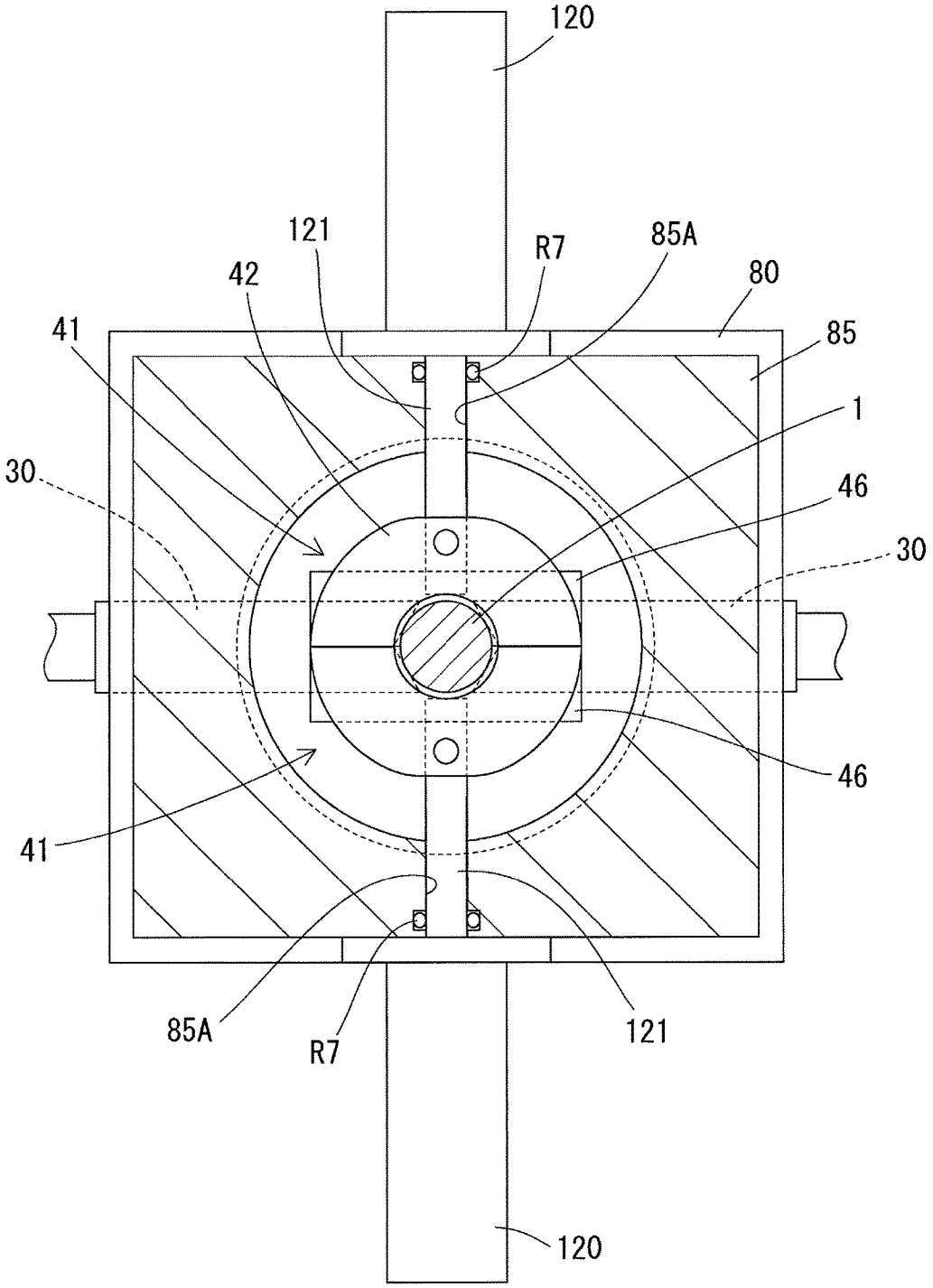
FIG. 17 is a horizontal sectional view showing the article held by the holding member.

Subsequently, the piston rods 121 of the air cylinders 120 connected to the holding member bodies 42 of the holding members 41 are moved forward, respectively. More specifically, the abutting parts 43 of the sponge sheets 46 are moved to the forward positions where the abutting parts 43 of the sponge sheets closely abut against respective portions of the outer periphery of the article 1 at the same level from both sides of the article 1 thereby to hold the article 1 therebetween, as shown in FIGS. 16 and 17. Further, the opposed end surfaces of the other parts of the sponge sheets 46 also abut closely against each other, so that the opposed flat surfaces of the holding member bodies 42 are in contact with each other.

Figure 18:
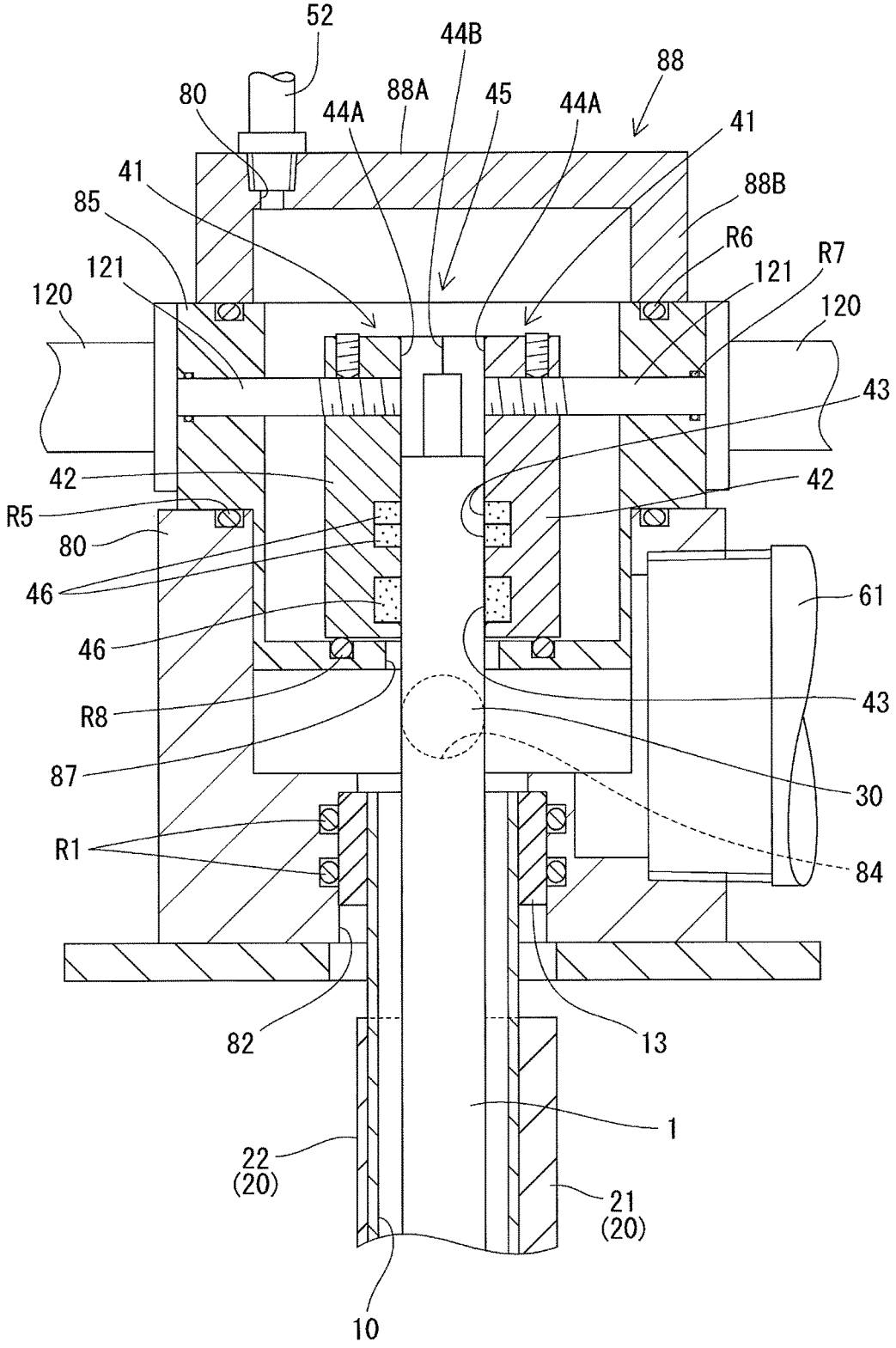
FIG. 18 is an enlarged view of a part of the high-speed plating machine located above the upper part of the anode, showing the article held by the holding member.

Next, the seal cover 88 is moved by the moving apparatus to a position where the seal cover 88 closes the upper opening of the base member 85, as shown in FIGS. 1, 2 and 18. The seal cover 88 is pressed downward at this position. The compressor 51 is then driven so that air is supplied into the air inlet 89 of the seal cover 88, thereby pressurizing the atmosphere in the holding chamber 45. In this case, the plating solution is circulated in a manner as will be described later. The compressor 51 is driven to supply air into the holding chamber 45 so that the holding chamber 45 is maintained at an inner pressure equal to or higher than an inner pressure in the region (corresponding to a liquid tank) where the plating solution flows between the article 1 and the anode 10.

The article 1 is disposed on the axis of the anode 10 in this state. More specifically, the inner periphery of the anode 10 is spaced away from the outer periphery of the article 1 lengthwise at a constant distance, so that the plating solution flows into the space.

Next, the pump 65 of the circulation unit 60 is driven to supply the plating solution in the plating solution control tank 64 to the plating solution inlet 93 of the lower receiving member 90 and thereafter to circulate the plating solution through the circulation path 63, that is, sequentially through the lower receiving member 90, the anode 10, the upper receiving member 80 and the plating solution outlet 83 back into the plating solution control tank 64. The plating solution flows between the anode 10 and the article 1.

The first and second power-supplying members 20 and 30 are energized by the power supply unit 70 so that positive voltage is applied to the anode 10 and negative voltage is applied to the article 1, whereby high-speed plating is carried out.

Thus, when the high-speed plating machine carries out the high-speed plating, the abutting parts 43 of the holding device 40 closely abut against the outer periphery of the columnar article 1 at the same level. Each abutting part 43 is comprised of chemical-resistant elastic sponge sheet 46. Further, the compressor 51 is configured to supply air to pressurize the atmosphere in the holding chamber 45. Accordingly, the abutting parts 43 comprised of the sponge sheet 46 are pressed by the pneumatic pressure with the result that the abutting parts 43 can closely adhere to the outer periphery of the article 1. Further, since the atmosphere in the holding chamber 45 is pressurized, the plating solution tending to leak to the holding chamber 45 side through interfaces between the abutting parts 43 and the article 1 or between the abutting parts 43 are pushed back by the pneumatic pressure. As a result, the holding device 40 can reliably prevent the plating solution from leaking from below the base member 85 into the housing part 86 of the base member 85. Further, since each abutting part 43 is comprised of the elastic sponge sheet 46, the abutting parts 43 can closely adhere to the outer periphery of the article 1 even when an outer peripheral configuration of the article 1 changes. As a result, the holding device 40 can deal with a plurality of types of articles. Still further, since the sponge sheet 46 formed into the abutting parts 43 is chemical-resistant, the abutting parts 43 can be prevented from deterioration by the plating solution with the result that leakage of plating solution can be prevented for a long period of time.

Accordingly, the holding device 40 and the high-speed plating machine provided with the holding device 40 can hold a plurality of types of articles to be plated and reliably prevent leakage of plating solution.

Upon completion of the high-speed plating, the first and second power-supplying members 20 and 30 are de-energized by the power supply unit 70. Further, the pump 65 of the circulation unit 60 is also stopped with the result that the plating solution is discharged out of the anode 10 to be stored in the plating solution control tank 64. The seal cover 88 is then moved by the moving apparatus from the position where the upper opening of the base member 85 is closed to a retreat position. The holding members 41 are then moved to the respective backward positions, the upper end of the article 1 is gripped by the chuck 5, and the second power-supplying members 30 are moved to respective backward positions. The article 1 is pushed upward by the support rod 15 while being pulled upward by the chuck 5, so that the article 1 is pulled out of the upper opening of the base member 85 with the result that the plating process is completed.

The present invention should not be limited by the foregoing embodiment described above with reference to the drawings but the scope of the invention involves the following embodiments.

(1) The anode is formed into the cylindrical shape in the foregoing embodiment. However, when an article with another shape is to be plated, the anode may be formed into a shape according to the shape of the article to be plated.

(2) The center members of the second power-supplying members are connected to the covering member by the screw in the foregoing embodiment. However, the inner periphery of the insertion space of the covering member and the outer periphery of the center member may each be formed into a tapered shape and the center member may be press fitted into the insertion space of the covering member.

(3) The covering member of the second power-supplying member covers the center member in a range wider than the part wetted with the plating solution. However, the covering member may cover at least the part wetted with the plating solution.

(4) The middle part of the long side of each sponge sheet is notched into the semicircular shape, and the notches serve as the abutting parts in the foregoing embodiment. However, the notched shape may be matched with the shape of the article. Further, no notches may be formed.

(5) The article is held by two holding members from two directions in the foregoing embodiment. However, the article may be held by three or more holding members so that the abutting parts closely abut against the outer periphery of the article at the same level.

(6) Two grooves holding the sponge sheets are provided at two heightwise spaced positions of the holding member bodies respectively in the foregoing embodiment. However, one, three or more grooves may be provided.

(7) In the foregoing embodiment, one sponge sheet or two overlapped sponge sheets are inserted into the grooves of the holding member bodies thereby to be held therein. However, three or more overlapped sponge sheets may be inserted into the grooves thereby to be held therein.

EXPLANATION OF REFERENCE SYMBOLS

1 . . . article to be plated
10 . . . anode
30 . . . second power-supplying member (power-supplying member)
31 . . . center member
32 . . . covering member
60 . . . circulation unit
70 . . . power supply unit

The invention claimed is:

1. A power-supplying member which is brought into contact with an article to be plated to apply negative voltage to the article, the article having a columnar part and being disposed in a state such that a space in which a plating solution flows is defined between an anode and the article, the power-supplying member comprising:
- a center member made from copper; and
- a covering member made from titanium and covering at least a part of a periphery of the center member, the covering member being wetted with the plating solution, the power-supplying member having a distal end including a notched part notched into a V-shaped, the notched part being configured for contact with an outer periphery of the columnar part during planting.

2. The power-supplying member according to claim 1, which is movable forward toward and backward away from the article disposed in the state such that the space in which the plating solution flows is defined between the anode and the article, and which power-supplying member is formed into a columnar shape, wherein a direction of forward/backward movement thereof corresponds with an axial direction of extension of the power-supplying member.

3. A high-speed plating machine comprising:
- a power-supplying member as defined in claim 2;
- an anode;
- a circulation unit configured to circulate a plating solution so that the plating solution flows between the anode and an article to be plated; and
- a power supply unit configured to energize the article via the anode and the power-supplying member.

4. A high-speed plating machine comprising:
- a power-supplying member as defined in claim 1;
- an anode;
- a circulation unit configured to circulate a plating solution so that the plating solution flows between the anode and an article to be plated; and
- a power supply unit configured to energize the article via the anode and the power-supplying member.

5. The power-supplying member according to claim 1, wherein the notched part has a valley defined by two interior surface portions of the covering member diverging from a common vertex, and wherein the interior surface portions are configured to each come in contact with a nested region of the outer periphery of the columnar part extended within the valley during plating.

6. A high-speed plating machine comprising:
- a power-supplying member as defined in claim 5;
- an anode;

a circulation unit configured to circulate a plating solution so that the plating solution flows between the anode and an article to be plated; and a power supply unit configured to energize the article via the anode and the power-supplying member.

* * * * *